US011466852B2

(12) United States Patent
Chen

(10) Patent No.: US 11,466,852 B2
(45) Date of Patent: Oct. 11, 2022

(54) END FITTING FOR AN EXHAUST PIPE

(71) Applicant: Chung-Cheng Chen, Taoyuan (TW)

(72) Inventor: Chung-Cheng Chen, Taoyuan (TW)

( * ) Notice: Subject to any disclaimer, the term of this patent is extended or adjusted under 35 U.S.C. 154(b) by 989 days.

(21) Appl. No.: 16/200,804

(22) Filed: Nov. 27, 2018

(65) Prior Publication Data

US 2020/0166210 A1 May 28, 2020

(51) Int. Cl.
*F23L 17/00* (2006.01)
*F23L 17/12* (2006.01)
*F23L 17/14* (2006.01)

(52) U.S. Cl.
CPC ..... *F23L 17/005* (2013.01); *F23L 17/12* (2013.01); *F23L 17/14* (2013.01)

(58) Field of Classification Search
CPC ..... F23L 17/12; F23L 17/14; F23J 2213/50
See application file for complete search history.

(56) References Cited

U.S. PATENT DOCUMENTS 4,545,291 A * 10/1985 Kutsch ..... E04D 13/174 454/365
11,195,737 B2 * 12/2021 Kuo ..... H01L 21/67294
2011/0151760 A1 * 6/2011 Olsen ..... F23L 17/14 454/41

* cited by examiner

*Primary Examiner* — David J Laux
(74) *Attorney, Agent, or Firm* — Rosenberg, Klein & Lee

(57) ABSTRACT

An end fitting for an exhaust pipe includes a cylindrical body having an upper opening and a lower opening. An inclined upper board is mounted in the cylindrical body. An upper passage is defined between a side of the upper board and an inner periphery of the cylindrical body. A first set of drain holes is defined in the lowest portion of the upper board. An inclined lower board is mounted in the cylindrical body and is located below the upper board. A lower passage is defined between a side of the lower board and the inner periphery of the cylindrical body. The lowest portion of the lower board is connected to the cylindrical body. The cylindrical body includes a cylindrical wall having a second set of drain holes. A ledge extends from the inner periphery of the cylindrical body and is located below the lower board.

6 Claims, 9 Drawing Sheets

END FITTING FOR AN EXHAUST PIPE

BACKGROUND OF THE INVENTION

The present invention relates to a pipe element and, more particularly, to an end fitting for an exhaust pipe.

Chimneys, exhaust pipes of buildings, or exhaust pipes of range hoods are used to discharge exhaust gas into the atmosphere. Considering the factor of rain, a conical or planar rain shield is generally disposed at a discharge end of an exhaust pipe by a hollow frame. However, in the case of heavy rain, rainwater still can enter via the hollow portions of the hollow frame, providing a limited effect. In another option, the discharge end of the exhaust pipe is arranged to face downwards, which causes hindrance and adversely affects the discharge effect.

BRIEF SUMMARY OF THE INVENTION

In view of the above disadvantages of the prior art, the present invention provides an end fitting for an exhaust pipe. The end fitting includes a cylindrical body having an upper opening and a lower opening. An upper board is mounted in an interior of the cylindrical body, is inclined, and extends at an angle to a first cross sectional plane of the cylindrical body. An upper passage is defined between a side of the upper board and an inner periphery of the cylindrical body. A first set of drain holes is defined in the lowest portion of the upper board. A lower board is mounted in the interior of the cylindrical body and is located below the upper board. The lower board is inclined and extends at an angle to a second cross sectional plane of the cylindrical body. A lower passage is defined between a side of the lower board and the inner periphery of the cylindrical body. The lowest portion of the lower board is connected to the cylindrical body. The cylindrical body includes a cylindrical wall having a second set of drain holes. A ledge extends from the inner periphery of the cylindrical body and is located below the lower board.

An exhaust pipe can be mounted in the lower opening of the cylindrical body and abuts the ledge to provide a secure fitting status. Screws extend radially from the outside of the cylindrical body into the exhaust pipe to thereby fix the exhaust pipe. In normal operation of the exhaust pipe, the exhaust gas moves from the lower passage through the upper passage and exits the upper opening. When it rains, even if rainwater enters via the upper opening of the cylindrical body, the rainwater can be guided through the upper passage beside the upper board onto the surface of the lower board. Then, the rainwater exits the cylindrical body via the second set of drain holes located at the lowest position of the lower board connected to the cylindrical body.

In an example, an inclination direction of the upper board is parallel to an inclination direction of the lower board, and the first set of drain holes intercommunicates with the upper passage.

In an example, a top board is mounted to a top of the cylindrical body and is located above the upper passage.

In an example, a fan is disposed in a third cross sectional plane of the cylindrical body.

In an example, the inclination direction of the upper board is opposite to the inclination direction of the lower board, and the first set of drain holes is defined in the cylindrical body and intercommunicates with the outside.

In an example, the end fitting further includes a movable lid mounted to the upper opening of the cylindrical body and a telescopic rod unit connected to the movable lid. The telescopic rod unit is operable to move the movable lid to close or open the upper opening.

The present invention will become clearer in light of the following detailed description of illustrative embodiments of this invention described in connection with the drawings.

DETAILED DESCRIPTION OF THE INVENTION

Figure 1:
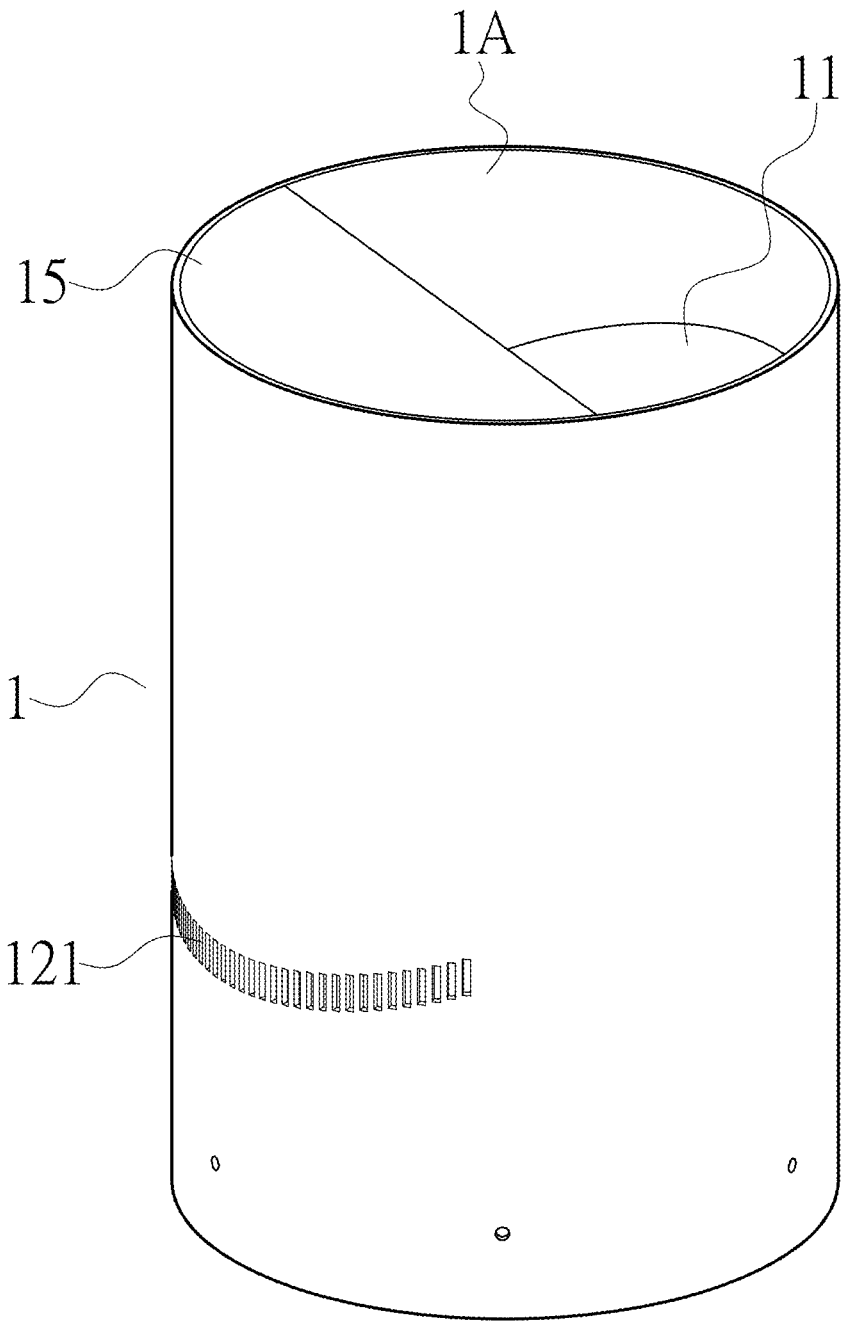
FIG. 1 is a perspective view of an end fitting for an exhaust pipe of an embodiment according to the present invention.
Figure 2:
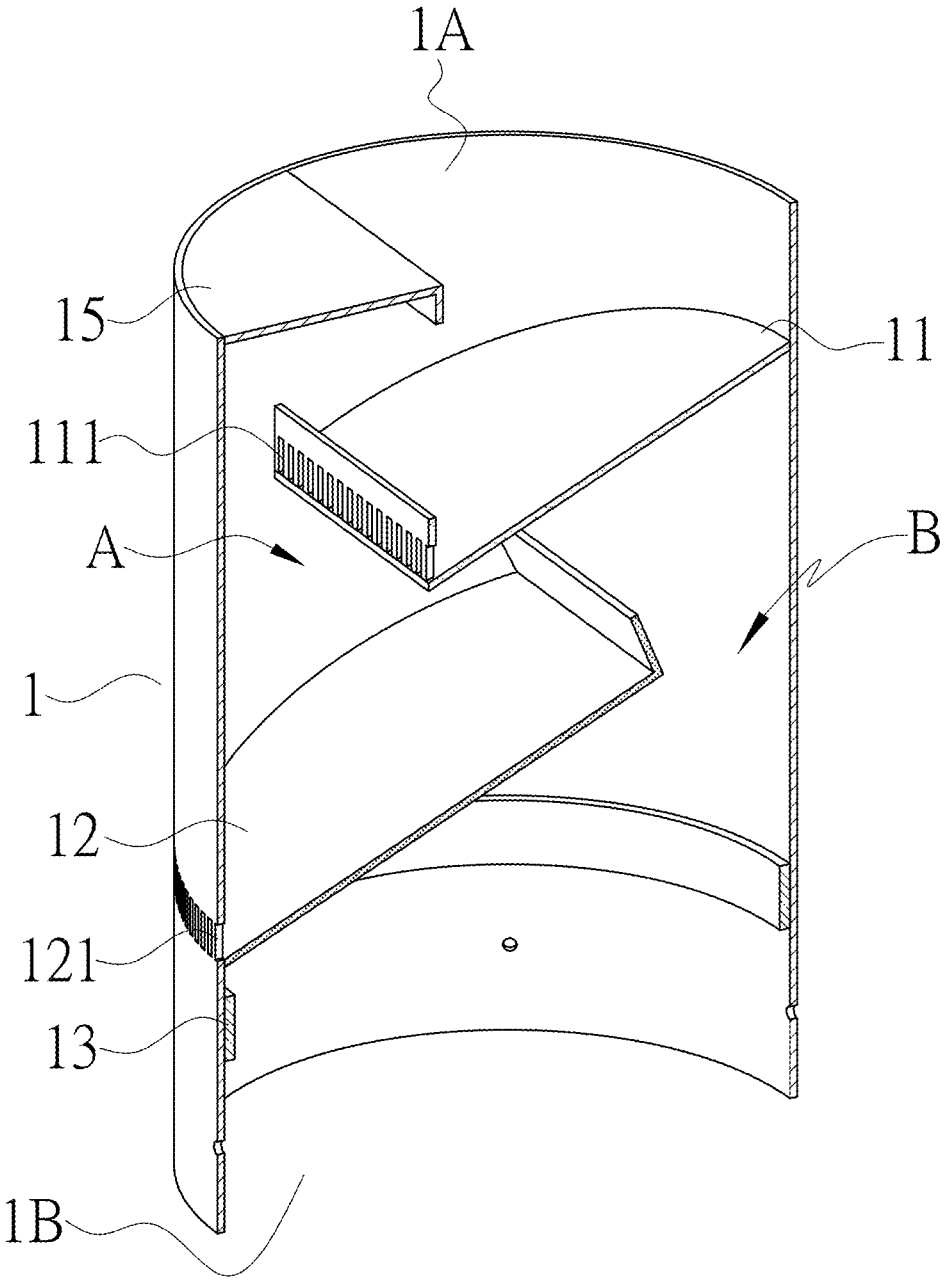
FIG. 2 is a cut-away perspective view of the end fitting of FIG. 1.
Figure 3:
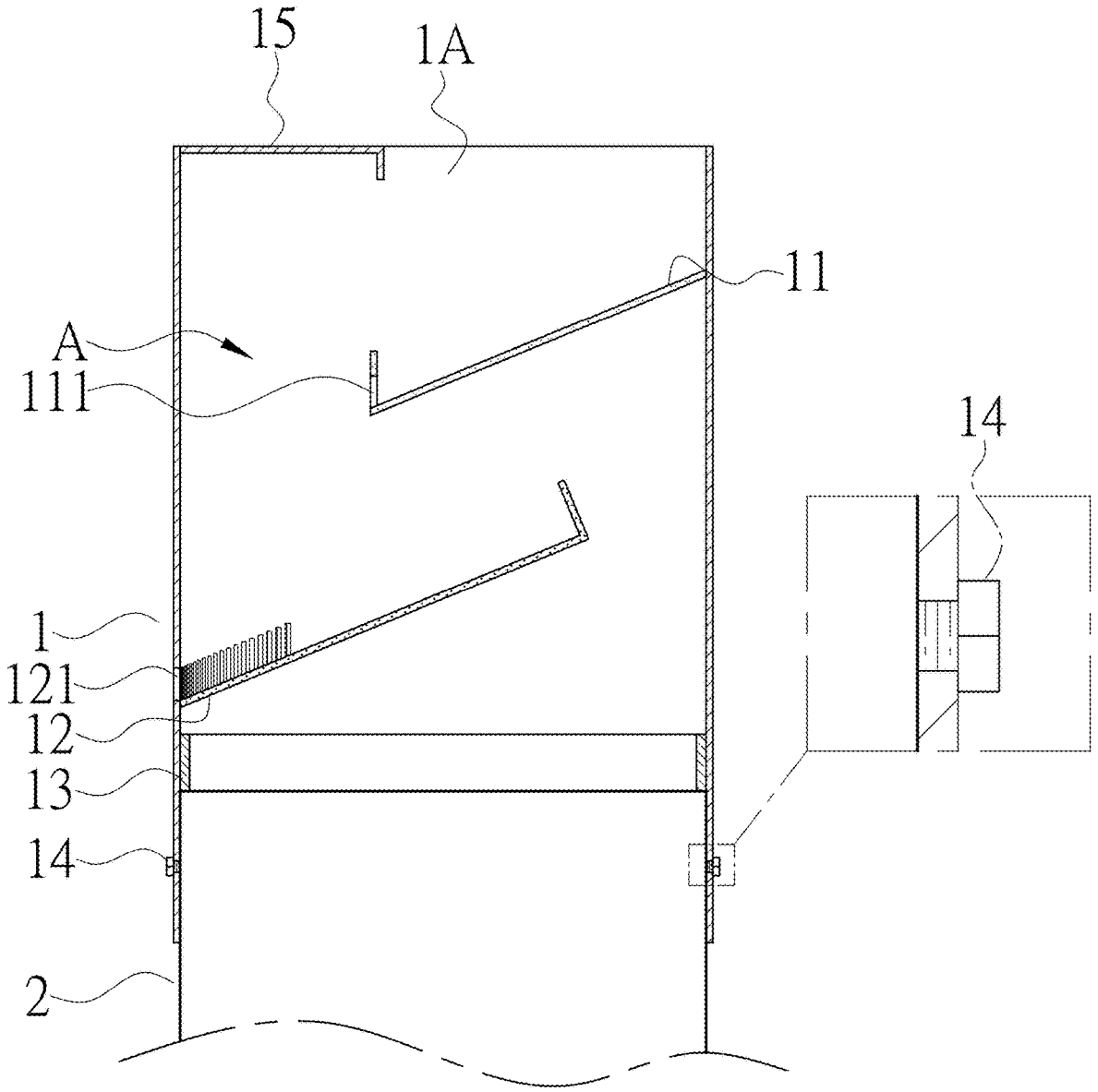
FIG. 3 is a cross sectional view of the end fitting of FIG. 1 and an exhaust pipe.

With reference to FIGS. 1-3, an end fitting for an exhaust pipe of an embodiment according to the present invention includes a cylindrical body 1 having an upper opening 1A and a lower opening 1B. An upper board 11 is mounted in an interior of the cylindrical body 1, is inclined, and extends at an angle to a first cross sectional plane of the cylindrical body 1. An upper passage A is defined between a side of the upper board 11 and an inner periphery of the cylindrical body 1. A first set of drain holes 111 is defined in the lowest portion of the upper board 11. A lower board 12 is mounted in the interior of the cylindrical body 1 and is located below the upper board 11. The lower board 12 is inclined and extends at an angle to a second cross sectional plane of the cylindrical body 1. A lower passage B is defined between a side of the lower board 12 and the inner periphery of the cylindrical body 1. The lowest portion of the lower board 12 is connected to the cylindrical body 1. The cylindrical body 1 includes a cylindrical wall having a second set of drain holes 121. A ledge 13 extends from the inner periphery of the cylindrical body 1 and is located below the lower board 12.

With reference to FIGS. 2 and 3, an exhaust pipe 2 can be mounted in the lower opening 1B of the cylindrical body 1 and abuts the ledge 13 to provide a secure fitting status. Screws 14 extend radially from the outside of the cylindrical body 1 into the exhaust pipe 2 to thereby fix the exhaust pipe 2.

In normal operation of the exhaust pipe 2, the exhaust gas moves from the lower passage B through the upper passage A and exits the upper opening 1A. When it rains, even if rainwater enters via the upper opening 1A of the cylindrical body 1, the rainwater can be guided through the upper passage A beside the upper board 11 onto the surface of the lower board 12. Then, the rainwater exits the cylindrical body 1 via the second set of drain holes 121 located at the lowest position of the lower board 12 connected to the cylindrical body 1.

In the embodiment shown in FIGS. 1-3, the inclination direction of the upper board 11 is parallel to the inclination direction of the lower board 12, such that the rainwater on the upper board 11 flows through the first set of drain holes 111 into the upper passage A (defined between the side of the upper board 11 and an inner periphery of the cylindrical body 1) and then flows downwards onto the surface of the lower board 12.

A top board 15 is mounted to a top of the cylindrical body 1 and is located above the upper passage A. In the case of heavy rain, the top board 15 can prevent the rainwater from directly pouring into the upper opening A, avoiding adverse influence to the discharge effect.

Figure 4:
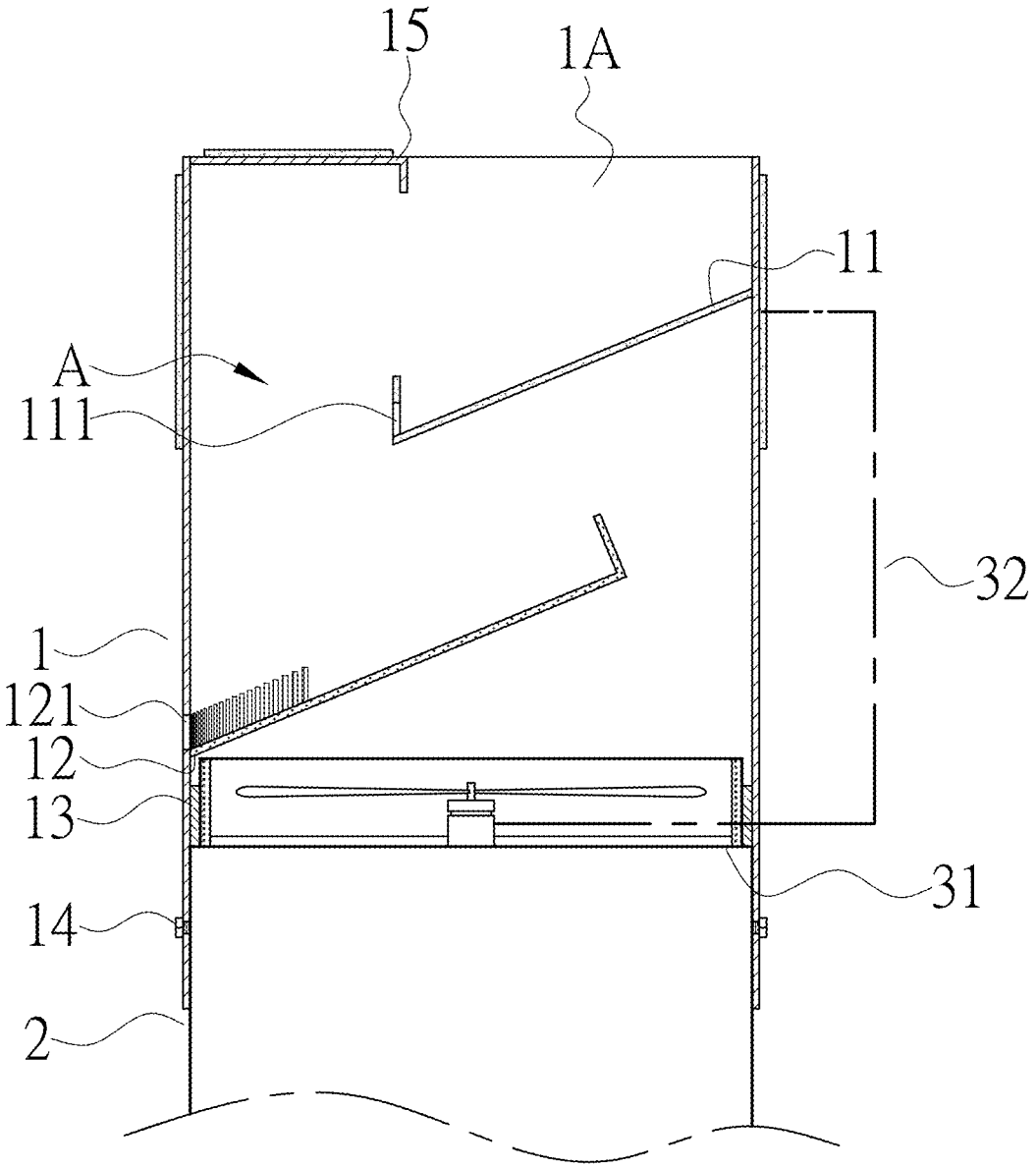
FIG. 4 is a cross sectional view of the end fitting of FIG. 1 and an exhaust pipe, with a fan and a solar power unit mounted to a cylindrical body of the end fitting.
Figure 5:
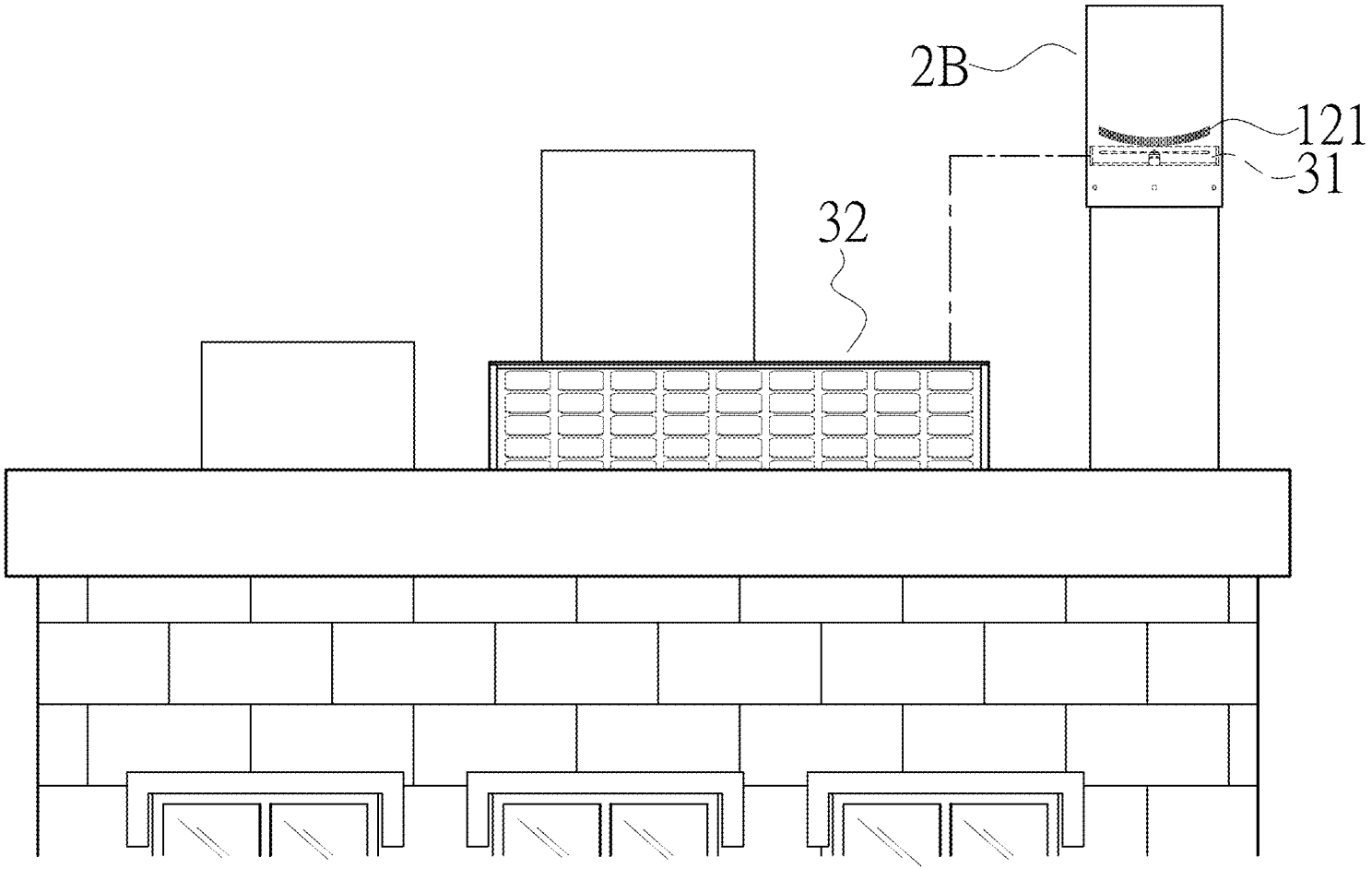
FIG. 5 is a cross sectional view of the end fitting of FIG. 1 mounted on an exhaust pipe of a building and coupled to a solar power unit.

With reference to FIG. 4, a fan 31 can be disposed in a third cross sectional plane of the cylindrical body 1 to enhance the discharge effect. Furthermore, a solar power unit 32 can be mounted to an outer periphery of the cylindrical body 12. In an alternative embodiment shown in FIG. 5, the solar power unit 32 is disposed outside of the cylindrical body 1 to provide power to the fan 31 and can be of solar tracking type.

Figure 6:
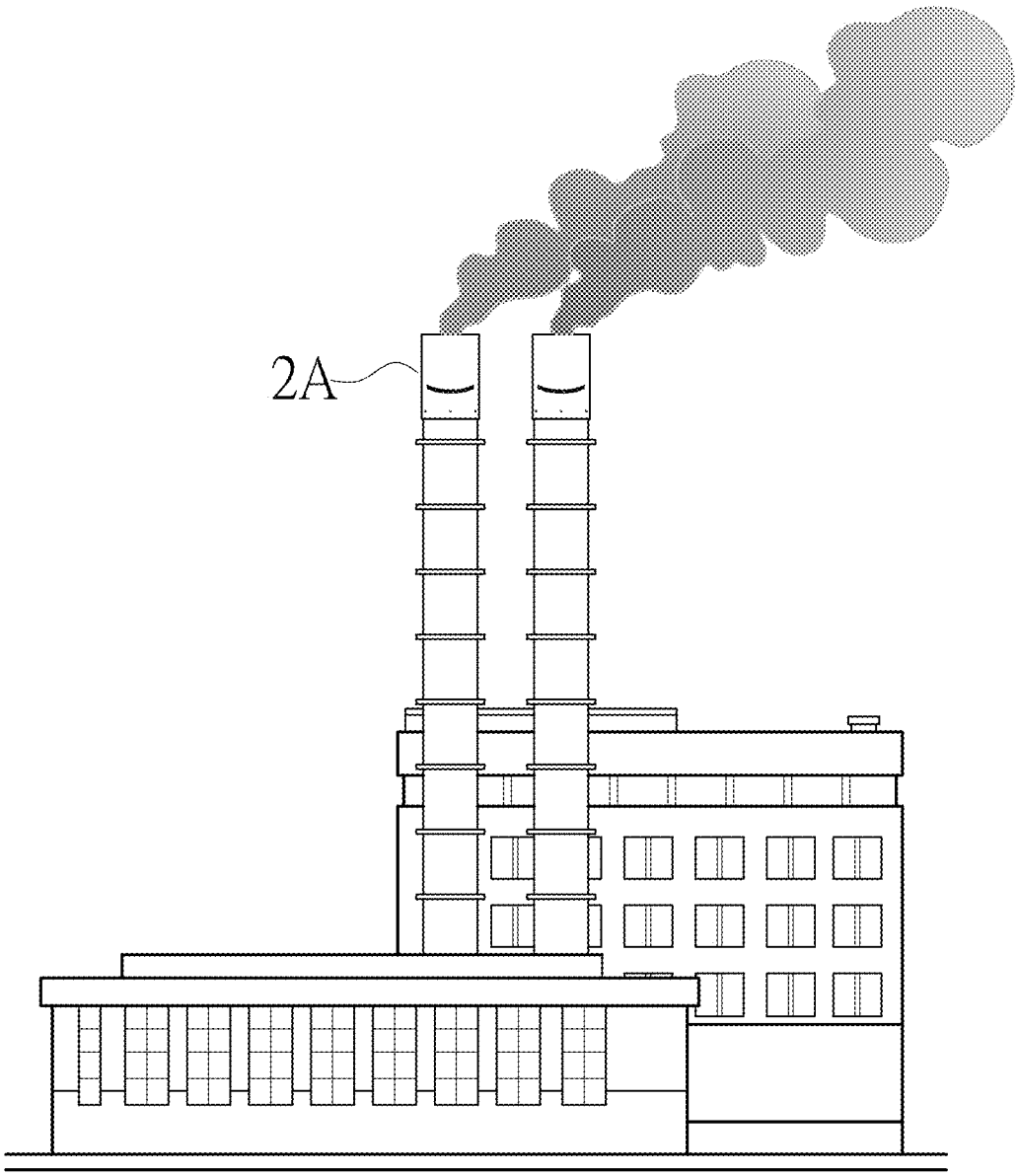
FIG. 6 is a cross sectional view of the end fitting of FIG. 1 mounted on an exhaust pipe of a chimney.
Figure 7:
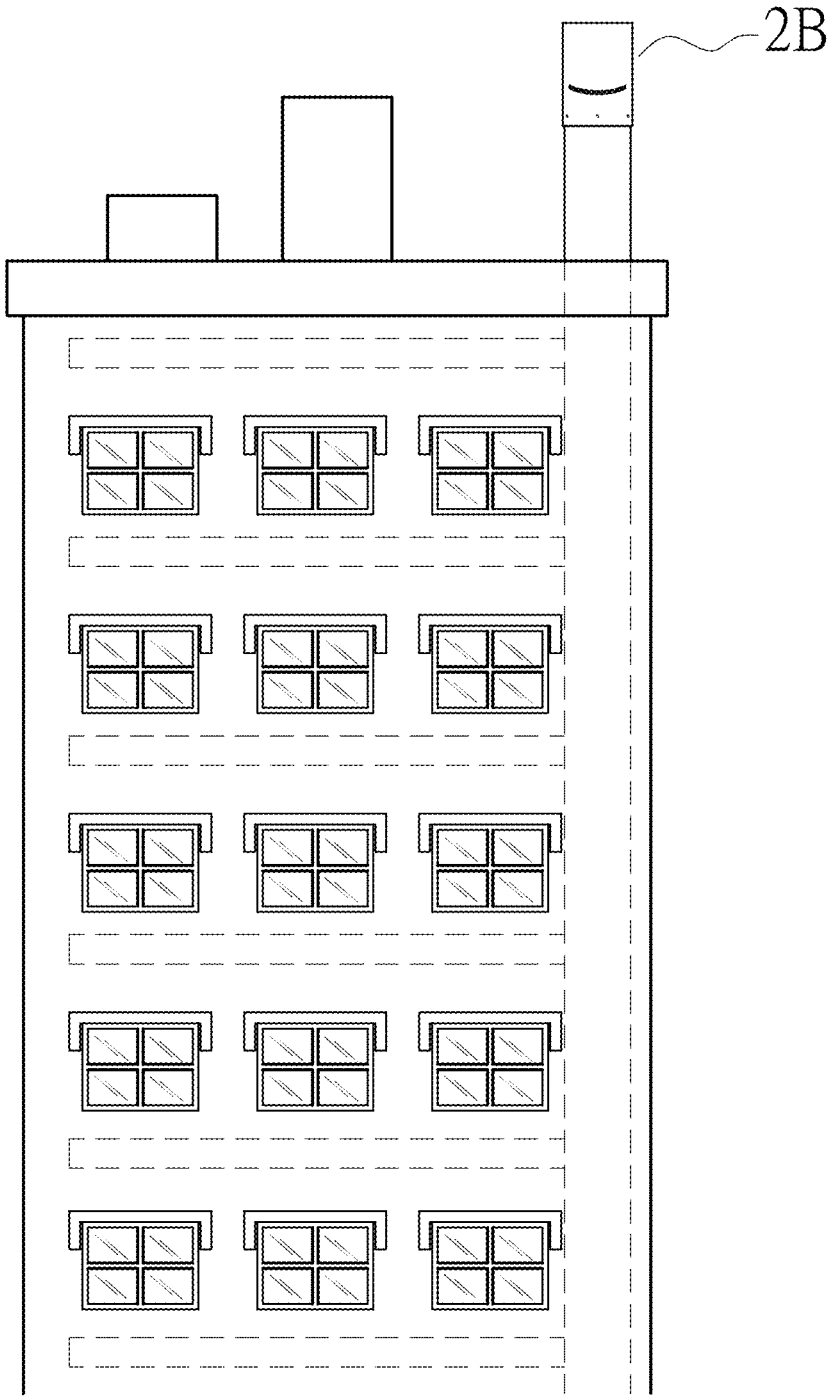
FIG. 7 is a cross sectional view of the end fitting of FIG. 1 mounted on an exhaust pipe of a building.

The end fitting according to the present invention can be used on various exhaust pipes, such as a chimney (see FIG. 6) or an exhaust pipe of a building (FIG. 7).

Figure 8:
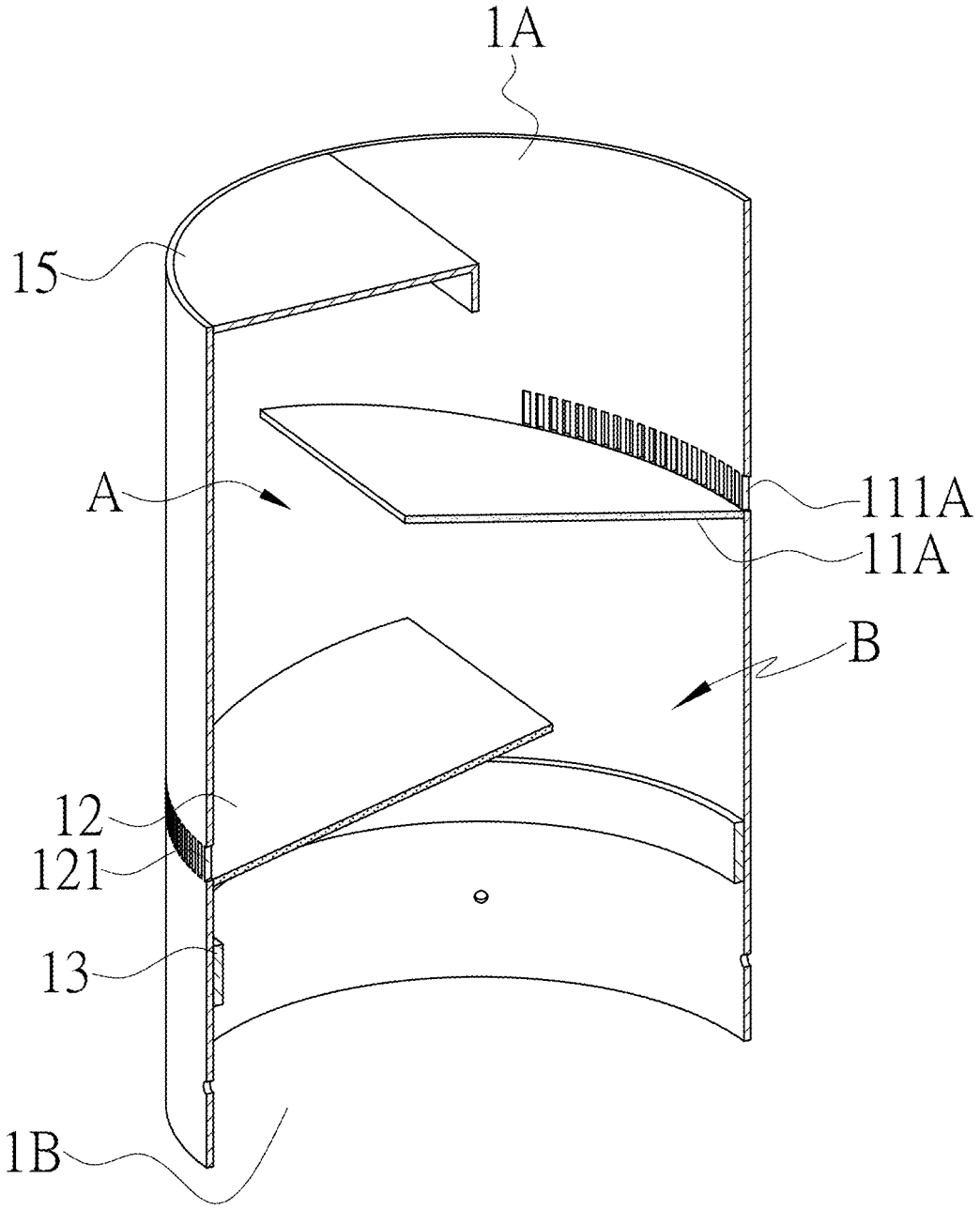
FIG. 8 is a cut-away perspective view of an end fitting for an exhaust pipe of another embodiment according to the present invention.

In an embodiment shown in FIG. 8, the inclination direction of the upper board 11 is opposite to an inclination direction of the lower board 1, such that the rainwater on the upper board 1A will not flow through the first set of drain holes 111 to the upper passage A. Instead, the rainwater may flow through the higher portion of the upper board 11 onto the surface of the lower board 12. To assist in the draining effect, the first set of drain holes 111 is defined in the cylindrical body 1 and intercommunicates with the outside. Thus, the rainwater falling onto the upper board 11 can be discharged to the outside via the first set of drain holes 111.

Figure 9:
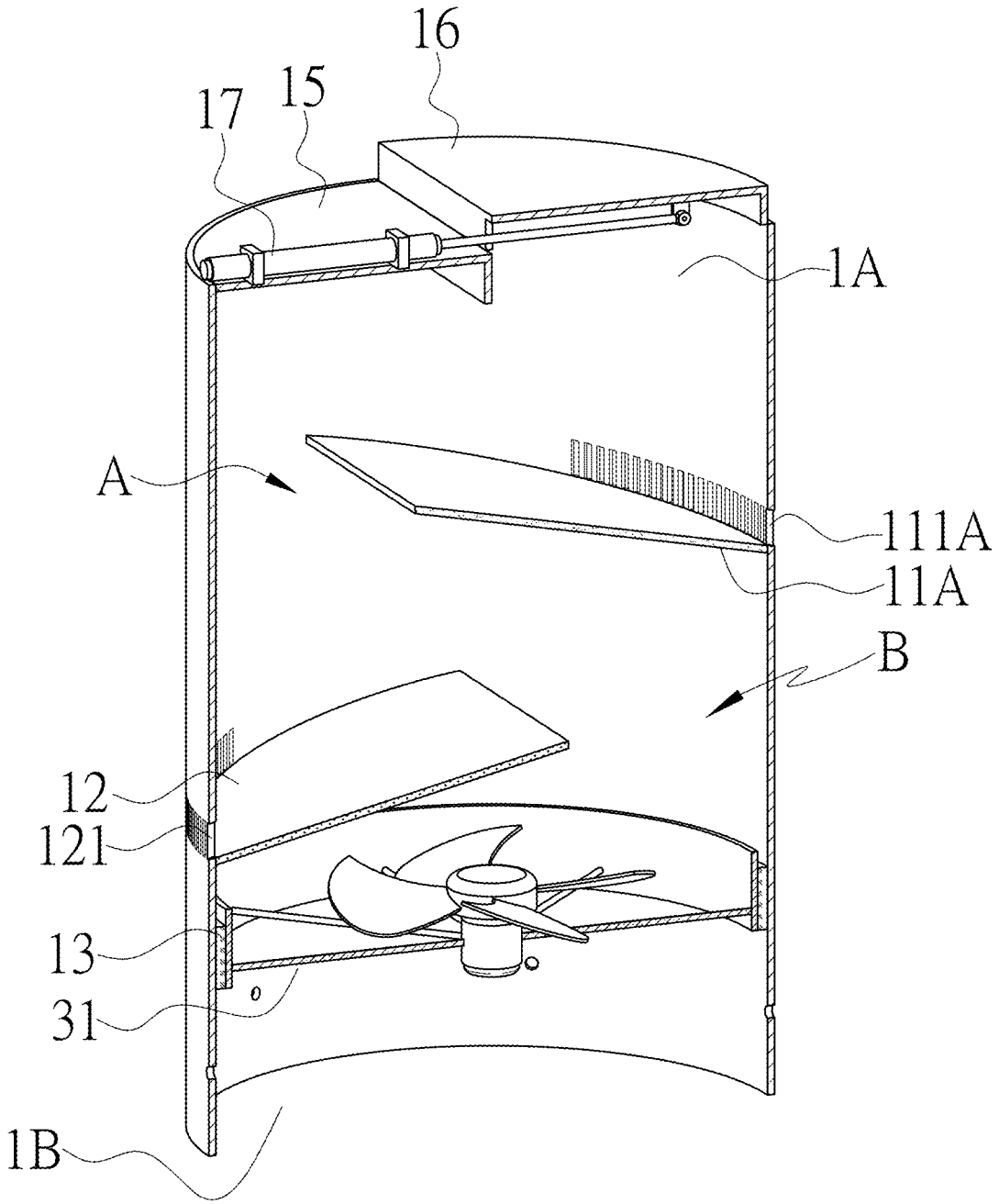
FIG. 9 is a cut-away perspective view of an end fitting for an exhaust pipe of a further embodiment according to the present invention.

With reference to FIG. 9, a movable lid 16 can be mounted to the upper opening 1A of the cylindrical body 1 and is connected to a telescopic rod unit 17. The telescopic rod unit 17 is operable to move the movable lid 16 to close or open the upper opening 1A.

Although specific embodiments have been illustrated and described, numerous modifications and variations are still possible without departing from the scope of the invention. The scope of the invention is limited by the accompanying claims.

What is claimed is:

1. An end fitting for an exhaust pipe, comprising a cylindrical body having an upper opening and a lower opening, wherein an upper board is mounted in an interior of the cylindrical body, is inclined, and extends at an angle to a first cross sectional plane of the cylindrical body, wherein an upper passage is defined between a side of the upper board and an inner periphery of the cylindrical body, wherein a first set of drain holes is defined in a lowest portion of the upper board, wherein a lower board is mounted in the interior of the cylindrical body and is located below the upper board, wherein the lower board is inclined and extends at an angle to a second cross sectional plane of the cylindrical body, wherein a lower passage is defined between a side of the lower board and the inner periphery of the cylindrical body, wherein a lowest portion of the lower board is connected to the cylindrical body, wherein the cylindrical body includes a cylindrical wall having a second set of drain holes, and wherein a ledge extends from the inner periphery of the cylindrical body and is located below the lower board.

2. The end fitting for the exhaust pipe as claimed in claim 1, wherein an inclination direction of the upper board is parallel to an inclination direction of the lower board, and wherein the first set of drain holes intercommunicates with the upper passage.

3. The end fitting for the exhaust pipe as claimed in claim 2, further comprising a top board mounted to a top of the cylindrical body and located above the upper passage.

4. The end fitting for the exhaust pipe as claimed in claim 1, further comprising a fan disposed in a third cross sectional plane of the cylindrical body.

5. The end fitting for the exhaust pipe as claimed in claim 1, wherein an inclination direction of the upper board is opposite to an inclination direction of the lower board, and wherein the first set of drain holes is defined in the cylindrical body and intercommunicates with an outside.

6. The end fitting for the exhaust pipe as claimed in claim 5, further comprising a movable lid mounted to the upper opening of the cylindrical body and a telescopic rod unit connected to the movable lid, wherein the telescopic rod unit is operable to move the movable lid to close or open the upper opening.

* * * * *